US006443471B1

(12) United States Patent
Mullen

(10) Patent No.: US 6,443,471 B1
(45) Date of Patent: Sep. 3, 2002

(54) SKATEBOARD TRUCK ASSEMBLY

(75) Inventor: Rodney Mullen, El Segundo, CA (US)

(73) Assignee: Dwindle, Inc., El Segundo, CA (US)

( * ) Notice: Subject to any disclaimer, the term of this patent is extended or adjusted under 35 U.S.C. 154(b) by 0 days.

(21) Appl. No.: 09/573,720

(22) Filed: May 17, 2000

(51) Int. Cl.[7] ..... A63C 17/26; A63C 17/01

(52) U.S. Cl. ..... 280/87.042

(58) Field of Search ..... 280/809, 811, 280/816, 842, 11.28, 87.01, 87.021, 87.041, 87.042; 301/5.3, 5.7

(56) References Cited

U.S. PATENT DOCUMENTS

| | | | | | |
|---|---|---|---|---|---|
| 4,084,831 | A | * | 4/1978 | Akonteh et al. | 280/87.042 |
| 4,109,925 | A | | 8/1978 | Williams et al. | 280/11.28 |
| 4,161,326 | A | * | 7/1979 | Gaber | 280/87.042 |
| 4,194,752 | A | | 3/1980 | Tilch et al. | 280/11.28 |
| 4,214,768 | A | * | 7/1980 | Dominy et al. | 280/809 |
| 4,218,098 | A | * | 8/1980 | Burton | 301/5.7 |
| 4,245,848 | A | * | 1/1981 | Dudouyt | 280/11.28 |
| 4,463,412 | A | | 7/1984 | Broach | 362/61 |
| 4,898,398 | A | * | 2/1990 | Cassel | 280/87.042 |
| 4,915,403 | A | * | 4/1990 | Wild et al. | 280/87.042 |
| 5,221,111 | A | * | 6/1993 | Younger | 280/809 |
| 5,347,681 | A | | 9/1994 | Wattron et al. | 16/30 |
| 5,803,473 | A | * | 9/1998 | Bouden | 280/87.042 |
| 5,806,860 | A | * | 9/1998 | Conte | 280/809 |
| 5,879,013 | A | * | 3/1999 | Shih | 280/11.28 |
| 6,056,302 | A | | 5/2000 | Smith | 280/87.042 |
| 6,089,580 | A | * | 7/2000 | Borel et al. | 280/809 |
| 6,105,978 | A | * | 8/2000 | Vuerchoz | 280/87.041 |

FOREIGN PATENT DOCUMENTS

| | | | |
|---|---|---|---|
| EP | 1 080 751 A1 | 3/2001 | |
| FR | 2586619 | 3/1987 | A63C/17/00 |

OTHER PUBLICATIONS

PCT Notification of Transmittal of the International Search Report or the Declaration, Nov. 7, 2001.
PCT International Search Report.
European Patent Office, European Search Report.

* cited by examiner

*Primary Examiner*—Frank Vanaman
(74) *Attorney, Agent, or Firm*—Sheppard, Mullin, Richter & Hampton LLP; James R. Brueggemann

(57) ABSTRACT

A skateboard having one or more truck assemblies configured to eliminate undesired ride characteristics such as hanger-jiggle and wheel bite, without sacrificing the skateboard's steering responsiveness. Each truck assembly includes an axle assembly with a ring-shaped hanger that is confined on a kingpin using a pair of bushings, at least one of which includes an annular flange that projects into an annular gap defined between the hanger and the kingpin. This prevents the hanger from moving laterally relative to the kingpin and thereby eliminates undesired ride characteristics such as hanger-jiggle and wheel bite. In a separate feature of the invention, the skateboard truck assembly further incorporates a low-friction slider plate that enhances the rider's performance of certain maneuvers and at the same time protects other components of the truck assembly from undue wear.

7 Claims, 5 Drawing Sheets

SKATEBOARD TRUCK ASSEMBLY

BACKGROUND OF THE INVENTION

This invention relates generally to skateboards and, more particularly, to skateboards incorporating truck assemblies configured to minimize hanger-jiggle and wheel bite.

Skateboards typically include an elongated platform having a pair of truck assemblies mounted at the opposite ends of its underside. Each truck assembly incorporates a base plate secured to the platform and an axle/wheel assembly having a pair of wheels for propelling the skateboard along a path generally aligned with the skateboard's longitudinal axis. The axle/wheel assembly includes an axle that mounts the two wheels at its opposite ends, and it further includes a pivot stem that projects radially outward from a mid-portion of the axle for seating in a recess formed in the base plate. A ring-shaped hanger also projects radially outward from a mid-portion of the axle, at a prescribed acute angle (e.g., 45 degrees) relative to the pivot stem, for engagement with a kingpin that projects downwardly from the base plate. Upper and lower bushings secure the hanger around the kingpin.

The truck assemblies described briefly above are configured to enable a rider to steer the skateboard simply by shifting his/her weight distribution rightward or leftward on the skateboard platform. This weight shift causes the platform to tilt correspondingly relative to the axles of the two truck assemblies, which remain at all times level relative to the ground. The axles thereby are caused to pivot horizontally about the axes of their associated kingpins, which in turn causes the skateboard to steer rightward or leftward. Riders generally desire to steer the skateboard using very slight shifts in their weight distribution. Loose or slack bushings generally allow greater movement of the ring-shaped hanger about the kingpin and thus are more responsive to slight weight shifts than are tight suspensions. However, loose or slack bushings can fail to prevent certain undesired ride characteristics.

One such undesired ride characteristic is hanger-jiggle, which occurs when the axle and hanger are allowed to move laterally relative to the axis of the kingpin. This can cause instability in the platform. Another such undesired ride characteristic is wheel bite, which occurs when the axle pivots excessively relative to the kingpin, to an extent that a wheel contacts the underside of the skateboard platform. This brakes the wheel and disturbs the rider's balance.

In the past, these undesirable ride characteristics typically have been avoided by tightening the bushings against the hanger. This tightening, however, can reduce the skateboard's steering responsiveness. It should, therefore, be appreciated that there is a need for a skateboard truck assembly that eliminates undesired ride characteristics such as hanger-jiggle and wheel bite, without sacrificing the skateboard's steering responsiveness.

Skateboard riders sometimes perform maneuvers called slides, in which a contact surface of the skateboard other than the wheels is made to slide along a fixed structure, such as a rail or a concrete wall. Because such riders typically seek to maximize the duration, speed and distance of the slides, a minimum loss of momentum is desired. However, friction between the skateboard's contact surface and the fixed structure can cause an excessive loss of momentum. This can make the maneuver difficult to perform and can damage the truck assembly. It should, therefore, be appreciated that there is a need for skateboard truck assembly configured to minimize a loss of momentum when the skateboard is used in a slide maneuver.

SUMMARY OF THE INVENTION

The present invention is embodied in a skateboard truck assembly configured to eliminate undesired ride characteristics such as hanger-jiggle and wheel bite, without sacrificing the skateboard's steering responsiveness. More particularly, the'truck assembly includes a base plate configured to be secured to the underside of a skateboard platform and further configured to have an underside that defines a pivot recess. A kingpin projects downwardly from the underside of the base plate, at a predetermined angle toward the pivot recess, along the skateboard's longitudinal axis. The truck assembly further incorporates an axle/wheel assembly that includes 1) an axle, 2) first and second wheels mounted for rotation at opposite ends of the axle, 3) a ring-shaped hanger that projects from a mid-portion of the axle and defining an opening sized to be larger than the kingpin's cross-section, and 4) a pivot stem that projects from a mid-portion of the axle for seating in the pivot recess. The axle/wheel assembly is mounted on the underside of the base plate with the axle oriented substantially perpendicular to the skateboard's longitudinal axis, with the pivot stem seated in the pivot recess, and with the hanger disposed around the kingpin, such that an annular gap is defined between the hanger and the kingpin. Finally, a bushing assembly is disposed on the kingpin, adjacent to the ring-shaped hanger, wherein the bushing assembly is sized and configured to inhibit both axial and lateral movement of the hanger relative to the kingpin, while permitting limited pivoting of the hanger about the axis of the kingpin.

In more detailed features of the invention, the bushing assembly includes first and second bushings that encircle the kingpin on opposite sides of the hanger, such that the hanger is sandwiched between them. At least one of the bushings includes an annular flange sized to fit into the annular gap defined between the hanger and the kingpin. The annular flange can be defined in just one of the bushings and an annular recess can be defined in the other bushing, for conformably receiving the annular flange. The bushings cane molded of polyurethane.

In another feature of the invention, the base plate is configured to include a generally flat upper surface for securement to the underside of the skateboard platform, and one or more protrusions can project upwardly from this surface for engagement with the platform. This enhances the securement of the truck assembly to the platform.

In a separate, independent feature of the invention, a low-friction slider plate can be secured to the base plate, on the side of the truck assembly opposite the kingpin. This minimizes friction between the skateboard and any fixed support structure during certain maneuvers. The slider plate can be flush with, or extend slightly beyond, the base plate. The slider plate can be located in a position such that it retains a pivot cup that defines the recess for seating the truck assembly's pivot stem.

Other features and advantages of the present invention will become apparent from the following description of the preferred embodiment, taken in conjunction with the accompanying drawings, which illustrate, by way of example, the principles of the invention.

DESCRIPTION OF THE PREFERRED EMBODIMENTS

Figure 1:
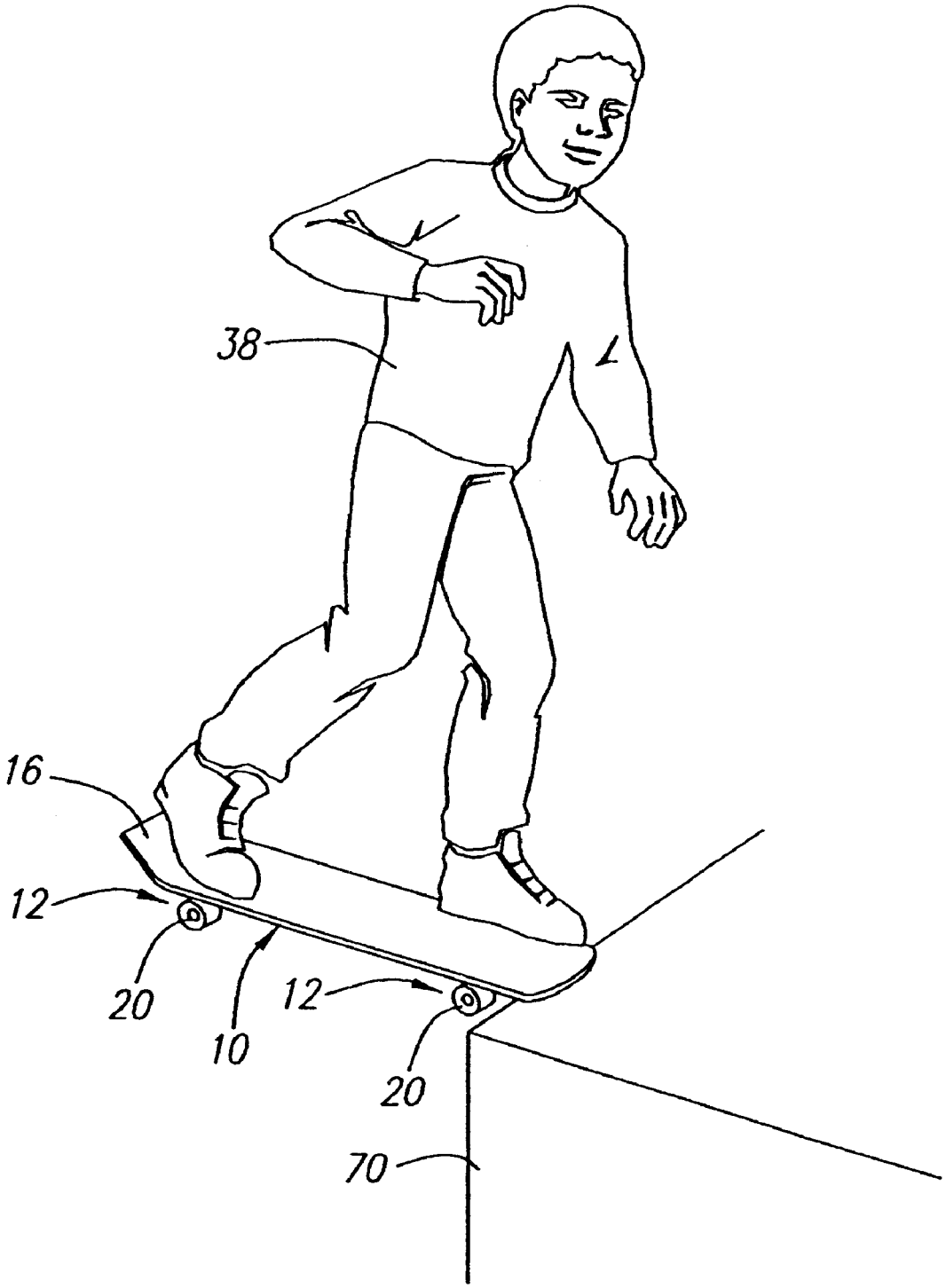
FIG. 1 is a perspective view of a skateboard and rider as he performs a slide maneuver along the upper edge of a concrete wall, with the underside of the skateboard platform and the facing surface of one of the skateboard's front truck assembly engaging the wall.

As shown in the exemplary drawings, and particularly in FIGS. 1, 2, 4 and 5, the invention is embodied in a skateboard 10 incorporating two improved truck assemblies 12. Each truck assembly includes a base plate 14 secured to one end of the underside of a skateboard platform 16, and it further includes an axle assembly 18 mounted on the base plate. Two wheels 20 are mounted at opposite ends of the axle assembly, for propelling the skateboard in a direction aligned generally with the skateboard's longitudinal axis.

As is conventional, the axle assembly 18 is configured to include a pivot stem 22 and a ring-shaped hanger 24 that are normal to, and project radially outward from, a mid-portion of the axle assembly, at an angle of about 45° relative to each other. The pivot stem is seated in a pivot recess 26 formed near one end of the base plate 14, and the hanger encircles a kingpin 28 that projects downwardly from the base plate at a location spaced from the recess. Upper and lower bushings 30 and 32, respectively, also encircle the kingpin, sandwiching the hanger. A nut 34 and washer 36 are attached to the threaded end of the kingpin, to secure the hanger and bushings in place. In its attached position, the axle assembly 18 is oriented such that the pivot stem 22 is seated in the pivot recess 26 at an angle of about 70° relative to the plane of the skateboard platform 16, in the direction of the kingpin 28. The kingpin also is oriented at an angle of about 70° relative to this same plane, but in the direction of the recess.

A rider 38 (FIG. 1) can steer the skateboard 10 leftward or rightward simply by shifting his/her weight to one side or the other on the skateboard platform 16, while the wheels 20 and the axle assembly 18 of each truck assembly 12 remain level relative to the ground. This weight shift, coupled with the non-perpendicular angle of the kingpin 28 relative to the plane of the platform, causes each axle assembly to pivot on its pivot stem 22 about the axis of its kingpin. The opening in the ring-shad hanger 24 is somewhat larger thee diameter of the kingpin, such that an annular gap 40 is formed between them, to facilitate this pivoting movement. Thus, a rightward weight shift causes the axle assembly of the skateboard's front truck assembly 12 to pivot to the right and the axle assembly of the rear truck assembly 12 to pivot to the left, steering the skateboard to the right. An opposite result occurs from a leftward weight shift.

Riders generally desire to steer the skateboard 10 using very slight shifts in their weight. In the past, this has been achieved by tightening the bushings 30 and 32 loosely on the ring-shaped hanger 24. This allows greater movement of the hanger about the kingpin 28 and thus greater responsiveness to slight weight shifts. However, loose or slack bushings. can fail to prevent undesired ride characteristics such as hanger-jiggle and wheel bite. There has been a need for a truck assembly that can provide the desired steering responsiveness without causing such undesired ride characteristics.

The skateboard truck assembly 12 of the invention satisfies this need by specially configuring the upper and lower bushings 30 and 32, respectively, to inhibit lateral movement of the hanger 24 relative to the kingpin 28. Specifically, the lower bushing 32 is configured to include an annular projection or flange 42 sized and positioned to project through the annular gap 40 located between the hanger and the kingpin, for reception in a mating annular recess 44 formed in the upper bushing 30. The outer periphery of the flange maintains continuous engagement with the hanger and thereby effectively prevents the hanger from moving laterally relative to the kingpin. This reduces the occurrence of hanger-jiggle and wheel bite. Moreover, it prevents this lateral movement without the need to excessively tighten the bushings onto the hanger, which could frictionally inhibit the desired pivoting of the hanger about the kingpin. The lack of lateral hanger movement causes steering response to be vastly improved.

The annular flange 42 of the lower bushing 32 is configured such that it provides proportionately greater resistance to tilting of the skateboard platform 16 as the rider 38 shifts his/her weight by an increasing amount. This enhances the skateboard's resistance to undesired wheel bite.

Figure 7:
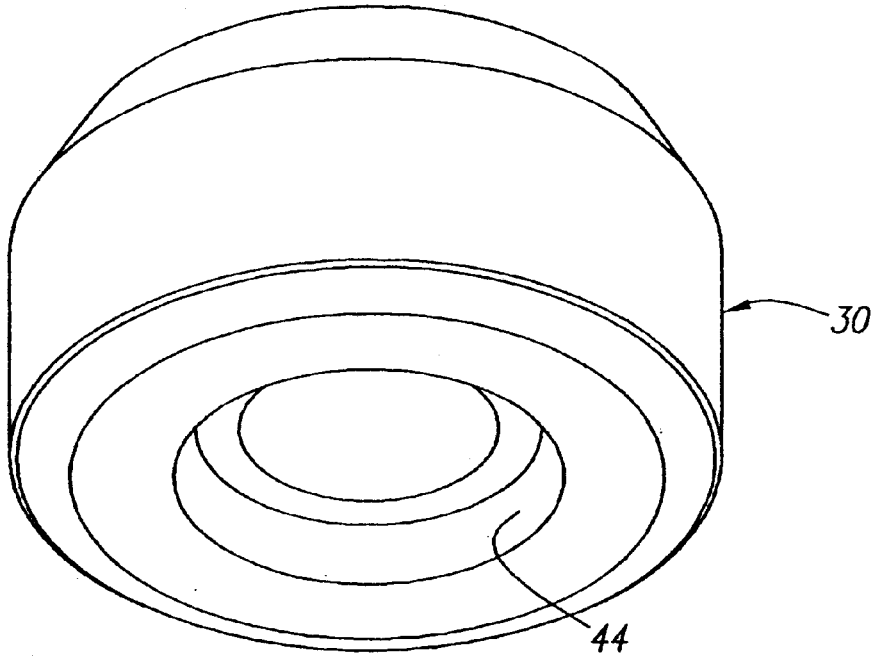
FIG. 7 is a bottom isometric view of an upper bushing that is part of the truck assembly of FIG. 2.

In the preferred embodiment, the upper bushing 30 (see FIG. 7) is generally cylindrical in shape, with an outer diameter of about 2.5 cm and a height of about 1.4 cm. A bore 46 of about 1 cm diameter extends longitudinally through the upper bushing, for receiving the kingpin 28. The annular recess 44 immediately surrounds the bore, with an outer diameter of about 1.4 cm and a depth of about 0.25 cm.

Figure 8:
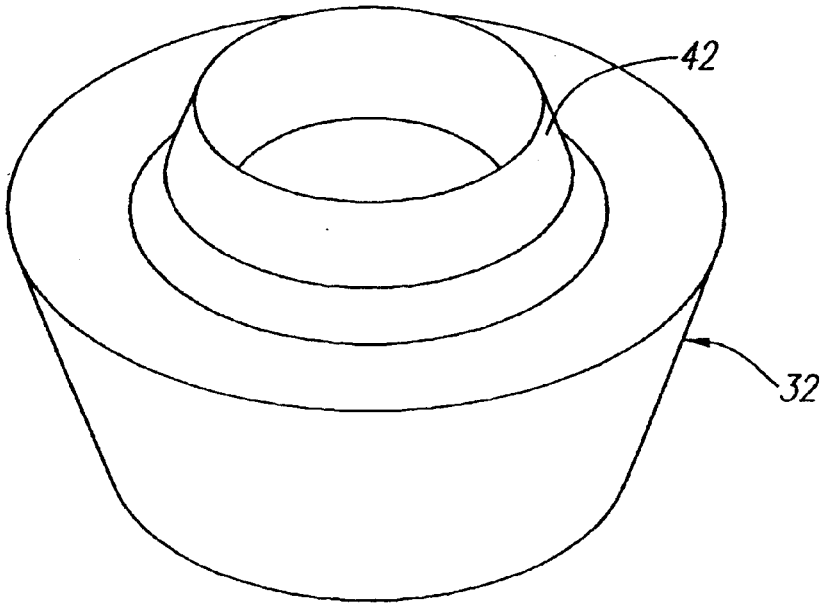
FIG. 8 is a top isometric view of a lower bushing that is part of the truck assembly of FIG. 2.

The lower bushing 32 (see FIG. 8) is generally frusto-conical in shape, with a diameter at its upper end of about 2.5 cm, a diameter at its lower end of about 2 cm, and a height of about 1 cm. A bore 48 of about 1 cm extends longitudinally through the lower bushing, for receiving the kingpin 28. The annular flange 42 immediately surrounds the bore 48, and it has a two-part frusto-conical shape. The flange's height is about 0.4 cm, just sufficient to extend through the annular gap 40 in the hanger 24 and nest in the annular recess 44 of the upper bushing 30.

The upper and lower bushings 30 and 32 both can be formed of a suitable resilient material such as polyurethane. It should be understood that the locations of the annular flange 42 and annular recess 44 on the respective lower and upper bushings alternatively could be reversed.

The axle assembly 18 preferably includes a main body 50 formed of cast aluminum and an axle 52 formed of hardened steel. The pivot stem 22 and the hanger 24 preferably are cast as part of this main body. The two ends of the axle are threaded, and a pair of nuts 54 secure the wheels 20 in place.

Figure 2:
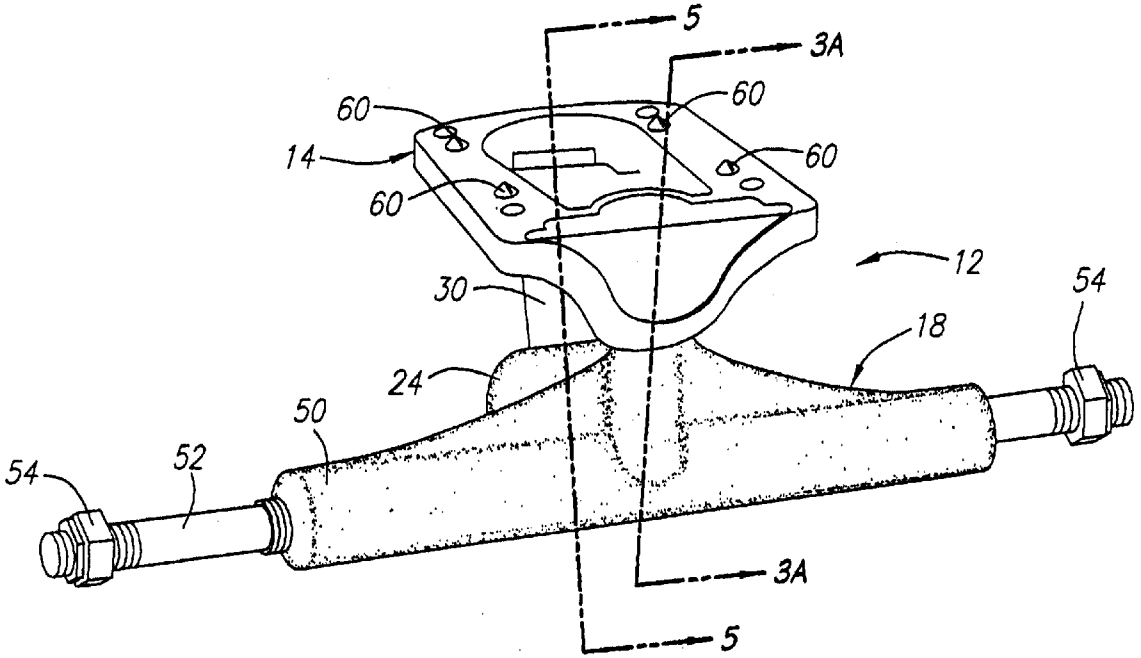
FIG. 2 is a front perspective view of a truck assembly of the skateboard of FIG. 1, with its wheels removed.
Figures 5, 6:
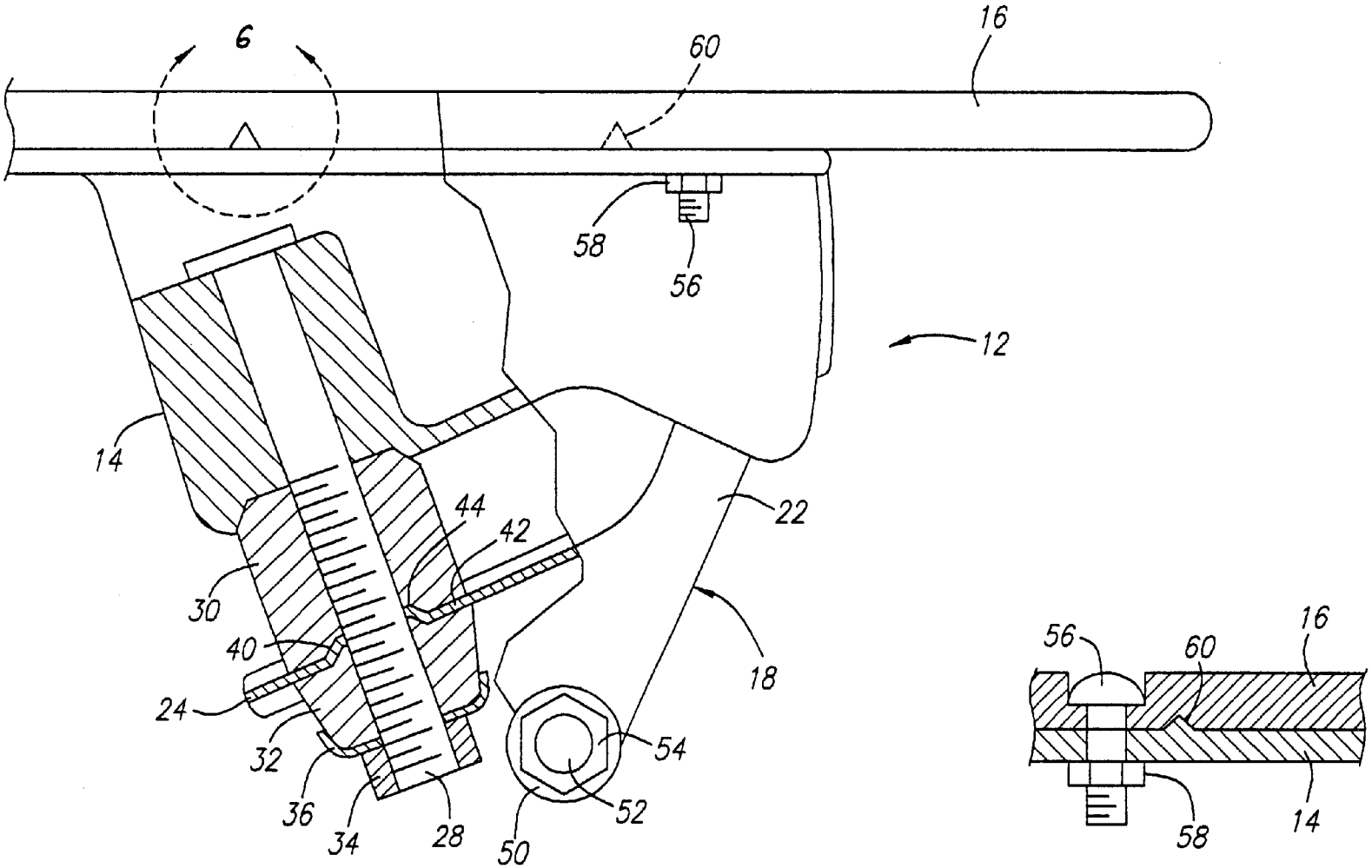
FIG. 5 is a side elevational view, partially broken away, of the truck assembly, taken in the direction of the arrows 5—5 in FIG. 2, the truck assembly being shown mounted on the underside of the skateboard platform.
FIG. 6 is a detailed cross-sectional view of the portion of the truck assembly and skateboard platform identified by the arrows 6 in FIG. 5, showing a bolt for attaching the truck assembly to the platform and further showing a conical projection that engages the underside of the platform.

As best shown in FIGS. 2, 5 and 6, the base plate 14 is secured to the underside of the skateboard platform 16 by four screws 56 and associated nuts 58. The base plate preferably is formed of cast aluminum, and its upper surface defines a flat, generally rectangular surface. Four conically shaped protrusions 60 project upwardly from the surface, for gripping engagement with the platform, to enhance the base plate's securement.

Figure 3B:
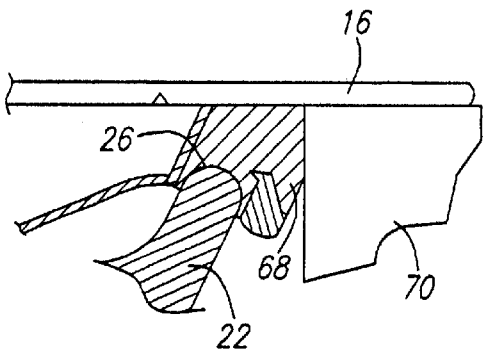
FIG. 3B is a cross-sectional view similar to FIG. 3A, but of an alternative embodiment in which the pivot cup and slider plate are integrated together as a single component.
Figure 3A:
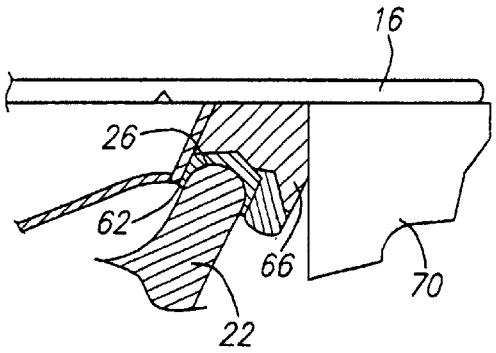
FIG. 3A is a fragmentary cross-sectional view of the truck assembly, taken in the direction of the arrows 3A—3A in FIG. 2, showing the skateboard's pivot cup and slider plate as two separate components.
Figure 4:
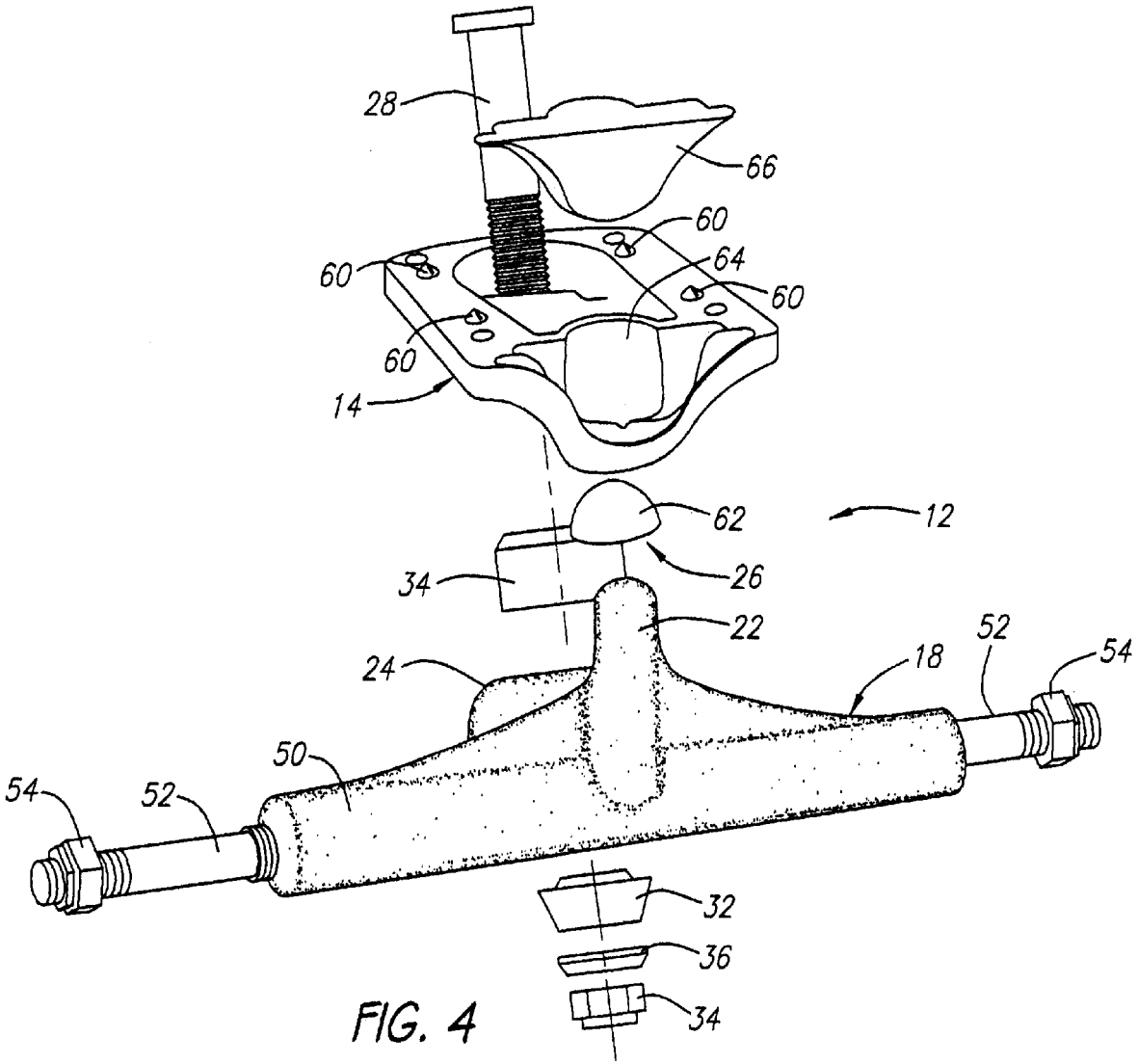
FIG. 4 is an exploded view of the truck assembly of FIG. 2.

As mentioned above, the pivot stem 22 of the axle assembly 12 is seated in the pivot recess 26 formed in the underside of the base plate 14. As shown in FIG. 3A, this pivot recess is formed by a special polyurethane pivot cup 62 that is seated in an opening 64 cast into the base plate. The pivot cup is backed by a plastic slider plate 66 whose function will be described below. The slider plate is installed in its position before the base plate is secured to the skateboard platform 16, after which it is automatically prevented from removal after the base plate has been secured in place. FIG. 3B depicts an alternative embodiment in which the pivot cup and slider plate are molded as a single plastic component 68.

In both cases, the plastic slider plate 66 of FIG. 3A and the slider plate 68 of FIG. 3*b* have irregular shapes and extend at least as far as, or preferably beyond, the furthest extent of the base plate 14. Consequently, the slider plate will be the particular component that engages an external support surface such as a concrete wall 70 (FIG. 1), when the rider 38 uses the skateboard 10 to perform a slide maneuver or the like. This plastic surface provides substantially less frictional resistance than would the cast aluminum base plate and, thereby, enables the rider to execute the maneuver with greater skill. At the same time, the slide plate protects the base plate from undue wear. The slide plate can be readily replaced without undue expense after it has been sacrificially worn-out.

It should be appreciated from the foregoing description that the present invention provides a skateboard having one or more improved truck assemblies configure to eliminate undesired ride characters such as hanger-jiggle and wheel bite, without sacrificing the skateboard's steering responsiveness. This is achieved by providing an axle assembly with a hanger that is confined on a kingpin using a pair of bushings, at least one of which includes an annular flange that projects into a annular gap defined between the hanger and the kingpin. This prevents the hanger from moving laterally relative to the kingpin and thereby eliminates undesired ride characteristics such as hanger-jiggle and wheel bite. In a separate feature of the invention, the skateboard truck assembly further incorporates a low-friction slider plate that enhances the rider's performance of certain maneuvers and at the same time protects other components of the truck assembly from undue wear.

While a particular form of the invention has been illustrated and described, it will be apparent that various modifications can be made without departing from the invention. Accordingly, the invention is to be defined only by the following claims.

I claim:

1. A skateboard truck assembly configured to be secured to the underside of a skateboard platform, the truck assembly comprising:

a base plate configured to be secured to the underside of the skateboard platform and further configured to have an underside that defines a pivot recess and a slider-plate recess;

a kingpin projecting downwardly from the underside of the base plate, from a location spaced from the pivot recess, wherein the base plate further is configured to have a substantially vertical facing surface adjacent to the pivot recess, on the side of the pivot recess opposite the kingpin, wherein the kingpin is oriented at a predetermined angle toward the pivot recess, and wherein the kingpin and the pivot recess are configured to be aligned with a longitudinal axis of the skateboard platform;

an axle/wheel assembly including an axle, first and second wheels mounted for rotation at opposite ends of the axle, a ring-shaped hanger projecting from a mid portion of the axle and defining an opening sized to be larger than the cross-section of the kingpin, and a pivot stem projecting from a mid portion of the axle and configured to be seated in the pivot recess defined in the underside of the base plate, wherein the axle/wheel assembly is mounted ton he underside of the base plate with the axle configured to be oriented substantially perpendicular to the longitudinal axis of the skateboard platform, with the pivot stem seated in the pivot recess, and with the hanger disposed around the kingpin, wherein an annular gap is defined between the hanger and the kingpin;

a bushing assembly disposed on the kingpin, adjacent to the ring-shaped hanger, wherein the bushing assembly includes an annular flange sized and configured to fit into the annular gap to inhibit both axial and lateral movement of he hanger relative to the kingpin, while permitting limited pivoting of the hanger about the axis of the kingpin; and a wear-resistant slider assembly secured adjacent to the facing surface of the base plate, the slider assembly includes a slider plate configured to be conformably received in the slider-plate recess and to extend flush with, or slightly beyond, the facing surface, and a pivot cup that frictionally rests in the pivot recess.

2. A skateboard truck assembly configured to be secured to the underside of a skateboard platform, the truck assembly comprising:

a base plate configured to be secured to the underside of the skateboard platform and further configured to have an underside that defines a pivot recess and a slider-plate recess;

a kingpin projecting downwardly from the underside of the base plate, from a location spaced from the pivot recess, wherein the base plate further is configured to have a substantially vertical facing surface adjacent to the pivot recess, on the side of the pivot recess opposite the kingpin, wherein the kingpin is oriented at a predetermined angle toward the pivot recess, and wherein the kingpin and the pivot recess are configured to be aligned with a longitudinal axis of the skateboard platform;

an axle/wheel assembly including an axle, first and second wheels mounted for rotation plate opposite ends of the axle, a ring-shaped hanger projecting from a mid portion of the axle and defining an opening sized to be larger than the cross-section of the kingpin, and a pivot stem projecting from a mid portion of the axle and configured to be seated in the pivot recess defined in the underside of the base plate, wherein the axle/wheel assembly is mounted on the underside of the base plate with the axle configured to be oriented substantially perpendicular to the longitudinal axis of the skateboard platform, with the pivot stem seated in the pivot recess, and with the hanger disposed around the kingpin, wherein an annular gap is defined between the hanger and the kingpin;

a bushing assembly disposed on the kingpin, adjacent to the ring-shaped hanger, wherein the bushing assembly includes an annular flange sized and configured to fill into the annular gap to inhibit both axial and lateral movement of the hanger relative to the kingpin, while permitting limited pivoting of the hanger about the axis of the kingpin; and a wear-resistant slider assembly secured adjacent to the facing surface of the base plate, the slider assembly includes a plastic slider plate configured to be conformably received in the slider-plate recess and to extend flush with, or slightly beyond, the facing surface, and a polyurethane pivot cup that frictionally rests in the pivot recess.

3. A skateboard truck assembly configured to be secured to the underside of a skateboard platform, the truck assembly comprising:

a base plate configured to be secured to the underside of the skateboard platform and further configured to have an underside that defines a pivot recess and to have a generally vertical facing surface adjacent to the pivot recess and a slider-plate recess;

a kingpin projecting downwardly from the underside of the base plate, from a location spaced from the pivot recess, wherein the kingpin is oriented at a predetermined angle toward the pivot recess, and wherein the kingpin and the pivot recess are configured to be aligned with a longitudinal axis of the skateboard platform;

an axle/wheel assembly having an axle, first and second wheels mounted for rotation at opposite ends of the axle, a ring-shaped hanger projecting from mid portion of the axle and defining an opening disposed over the kingpin, and a pivot stem projecting from a mid portion of the axle and configured to be seated in the pivot recess deaned in the underside of the base plate, wherein the axle/wheel assembly is mounted on the underside of the base plate with the axle configured to be oriented substantially perpendicular to the longitudinal axis of the skateboard platform, with the pivot projection seated in the pivot recess defined in the underside of the base plate, and with the hanger disposed around the kingpin; and a low-friction slider plate configured to have a substantially flat front surface and to be conformably received in the slider-plate recess and positioned adjacent to both the pivot recess and the substantially vertical facing surface of the base plate.

4. A skateboard truck assembly as defined in claim 3, wherein the pivot recess is further defined by a pivot cup positioned in the opening defined by the base plate, wherein the pivot cup is supported by the low-front slider plate.

5. A skateboard truck assembly configured to be secured to the underside of a skateboard platform, the truck assembly comprising:

a base plate configured to be secured to the underside of the skateboard platform, further configured to define a pivot recess and a slider-plate recess, the base plate having a substantially vertical facing surface adjacent to the pivot recess;

a kingpin projecting downwardly from the underside of the base plate, from a location spaced from the pivot recess, wherein the kingpin is oriented at a predetermined angle toward the pivot recess, and wherein the kingpin and the pivot recess are configured to be aligned with a longitudinal axis of the skateboard platform, the facing surface located forward of the pivot recess relative to the kingpin;

an axle/wheel assembly including an axle, first and second wheels mounted for rotation at opposite ends of the axle, a ring-shaped hanger projecting from mid portion of the axle and defining an opening sized to be larger than the cross-section section of the kingpin, and a pivot stem projecting from a mid portion of the axle and configured to be seated in the pivot recess defined in the underside of the base plate, wherein the axle/wheel assembly is mounted on the underside of the base plate with the axle configured to be oriented substantially perpendicular to the longitudinal axis of the skateboard platform, with the pivot stem seated in the pivot recess, and with the hanger disposed around the kingpin, wherein an annular gap is defined between the hinge and the kingpin;

a bushing assembly disposed on the kingpin, adjacent to the ring-shaped hanger, wherein the bushing assembly is sized and configured to inhibit both axial and lateral movement of the hanger relative to the kingpin, while permitting limited pivoting of the hanger about the axis of the kingpin; and a wear resistant slider assembly including a slider plate configured to be conformably received in the slider-plate recess, secured adjacent to the facing surface of the base plate and extending flush with, or slightly beyond, the facing surface, and a pivot cup that frictionally rests in the pivot recess.

6. A skateboard truck assembly as defined in claim 5, wherein the pivot cup is formed of polyurethane, and the slider plate is formed of a plastic material.

7. A skateboard truck assembly configured to be secured to the underside of a skateboard platform, the truck assembly comprising:

a base plate configured to be secured to the underside of the skateboard platform and further configured to have an underside that defines a pivot recess and to have a generally vertical facing surface adjacent to the pivot recess;

a kingpin projecting downwardly from the underside of the base plate, from a location spaced from the pivot recess, wherein the kingpin is oriented at a predetermined angle toward the pivot recess, and wherein the kingpin and the pivot recess are configured to be aligned with a longitudinal axis of the skateboard platform;

an axle/wheel assembly having an axle, first and second wheels mounted for notation at opposite ends of the axle, a ring-shaped hanger projecting from a mid portion of the axle and defining an opening disposed over the kingpin, and a pivot stem projecting from a mid portion of the axle and configured to be seated in the pivot recess defined in the underside of the base plate, wherein the axle/wheel assembly is mounted on the underside of the base plate with the axle configured to be oriented substantially perpendicular to the longitude axis of the skateboard platform, with the pivot projection seated in the pivot recess defined in the underside of the base plate, and with the hanger disposed around the kingpin; and a low-friction slider plate configured to have a substantially flat front surface and to be securely form-fit into an opening defined by the base plate and positioned adjacent to both the pivot recess and the substantially vertical facing surface of the base plate, wherein the pivot recess is further defined by a pivot cup positioned in the opening defined by the base plate, wherein the pivot cup is supported by the low-friction slider plate.

* * * * *

UNITED STATES PATENT AND TRADEMARK OFFICE

CERTIFICATE OF CORRECTION

PATENT NO. : 6,443,471 B1
DATED : September 3, 2002
INVENTOR(S) : Rodney Mullen

It is certified that error appears in the above-identified patent and that said Letters Patent is hereby corrected as shown below:

Column 2,
Line 7, change "the 'truck" to -- the truck --
Line 39, change "cane" to -- can be --

Column 3,
Line 64, change "shad" to -- shaped --
Line 64, change "thee" to -- than the --

Column 5,
Line 37, change "configure" to -- configured --
Line 38, change "characters" to -- characteristics --

Column 6,
Line 18, change "ton he" to -- on the --
Line 30, change "he" to -- the --
Line 58, change "plate" to -- at --

Column 7,
Line 9, change "fill" to -- fit --
Line 41, add "a" before "mid"
Line 46, change "deaned" to -- defined --
Line 62, change "front" to -- friction --

Column 8,
Line 17, add -- a -- before "mid"
Line 18, change "section section" to -- section --
Line 28, change "hinge" to -- hanger --
Line 63, change "notation" to -- rotation --

UNITED STATES PATENT AND TRADEMARK OFFICE

CERTIFICATE OF CORRECTION

PATENT NO. : 6,443,471 B1
DATED : September 3, 2002
INVENTOR(S) : Rodney Mullen

It is certified that error appears in the above-identified patent and that said Letters Patent is hereby corrected as shown below:

Column 9,
Line 7, change "longitude" to -- longitudinal --

Column 10,
Line 2, change "securely" to -- securedly --

Signed and Sealed this

Eleventh Day of February, 2003

JAMES E. ROGAN
*Director of the United States Patent and Trademark Office*